US005728349A

United States Patent [19]

Persson

[11] Patent Number: 5,728,349

[45] Date of Patent: Mar. 17, 1998

[54] MATERIAL PRIMARILY FOR SPORT-SHOOTING AMMUNITION

[76] Inventor: Leif Persson, Häggbovägen 8, S-718 40 Dylta Bruk, Sweden

[21] Appl. No.: 532,575

[22] PCT Filed: Apr. 25, 1994

[86] PCT No.: PCT/SE94/00364

§ 371 Date: Oct. 20, 1995

§ 102(e) Date: Oct. 20, 1995

[87] PCT Pub. No.: WO94/25817

PCT Pub. Date: Nov. 10, 1994

[30] Foreign Application Priority Data

Apr. 26, 1993 [SE] Sweden ..... 9301394-4

[51] Int. Cl.[6] ..... F42B 7/04

[52] U.S. Cl. ..... 420/513; 420/524; 102/501

[58] Field of Search ..... 420/513, 524; 102/501

[56] References Cited

U.S. PATENT DOCUMENTS

| | | | |
|---|---|---|---|
| 4,115,604 | 9/1978 | Bernstein | 427/329 |
| 5,189,252 | 2/1993 | Huffman et al. | 102/459 |

FOREIGN PATENT DOCUMENTS

| | | | |
|---|---|---|---|
| 56-69340 | 6/1981 | Japan | 420/524 |
| 9203336 | 5/1994 | Sweden . | |
| 6993 | 10/1897 | United Kingdom | 420/524 |
| 2211920 | 7/1989 | United Kingdom . | |
| WO91/00491 | 1/1991 | WIPO . | |

OTHER PUBLICATIONS

Hansen, P.M., Constitution of Binary Alloys, 2nd Edition, McGraw-Hill Book Company, 1958, pp. 346–347.

*Primary Examiner*—Sikyin Ip

*Attorney, Agent, or Firm*—Alfred J. Mangels

[57] ABSTRACT

A material primarily for sport-shooting ammunition, both pellet ammunition and ball ammunition, including at least the materials zinc and bismuth. The ammunition material includes above 55 percent by weight zinc and the remainder bismuth and tin, where the amount of tin present does not exceed about 10 percent by weight tin.

4 Claims, No Drawings

MATERIAL PRIMARILY FOR SPORT-SHOOTING AMMUNITION

BACKGROUND OF THE INVENTION

1. Field of the Invention

The present invention relates to material primarily for sport-shooting ammunition. Hunting and sporting ammunition is normally produced from lead, which applies both to ball ammunition and to BB-shot or pellet ammunition.

2. Description of the Related Art

The use of lead, particularly lead pellets, for hunting purposes has a pronounced negative affect on the environment. About 600 tonnes of lead are scattered annually over the countryside in Sweden alone, in conjunction with sport-shooting activities.

When using lead pellets for hunting purposes, a very large quantity of lead is scattered throughout the countryside in an uncontrollable fashion, which is negative from an environmental aspect.

One particularly negative aspect of the use of BB lead pellets or shot to shoot birds is that the pellets are scattered in a manner which results in some of the pellets being ingested by birds and resulting in lead poisoning. Naturally, this can lead to the death of some birds. Furthermore, people who, in turn, eat birds which have eaten lead shot will also ingest a certain amount of lead.

On the other hand, lead ammunition has very good ballistic properties and also high energetic properties, in other words lead pellets produce a satisfactorily high energy impulse when striking the target. These properties are, to a great extent, allied with the specific gravity of lead, i.e. its density.

It would seem that those weapons used for hunting and sporting purposes are designed and dimensioned for use with lead ammunition.

Iron ammunition in the form of iron pellets is also available commercially. The density of iron, however, is too low to provide the same good ballistic and energetic properties of lead, and consequently iron pellets have a limited use.

Furthermore, iron pellets generate a higher barrel pressure, partly because the pellets are harder than lead pellets, and consequently the pellets do not deform equally as easily in the confinement of the barrel. Iron pellets also subject the barrels of the shotgun to greater wear than lead pellets.

Obviously, it would be desirable to be able to replace lead with a material that possesses the same good properties as lead with regard to density and hardness, and which at the same time is less hazardous to the environment.

Hunting ammunition material is described in Swedish Patent Specification No. 9203336-4. The ammunition material according to this patent specification includes at least one of the materials tungsten carbide (WC) or ferrotungsten (FeW) in powder form, and a material of low melting point which functions to bind the powder material to a coherent body. The powder material and the binding material are included in the ammunition material in proportions such as to give the ammunition material a density which corresponds to or is in the same order of magnitude as the density of lead.

The material just mentioned is, however, primarily intended for hunting purposes. The material is relatively expensive to produce, however, making it uneconomical for sport-shooting, where a normal sportsman may use 3,000–10,000 cartridges in a season. The cartridge price of the ammunition is relatively unimportant when the ammunition is used for hunting purposes.

The above-described problem associated with the use of lead pellets or shot is also discussed in the International Publication No. WO 91/00491. WO 91/00491 describes an ammunition in which lead pellets have been replaced with a non-toxic alloy which contains primarily bismuth, or is comprised at least more than 50% bismuth. The remainder of the alloy is said to comprise zinc, tin, antimony or the like, or a mixture thereof. The publication states that a very high bismuth content, more particularly a bismuth content of up to 98%, is particularly preferred, since the ballistic properties of the pellets will then approach or be essentially the same as the ballistic properties of lead pellets.

However, bismuth is an expensive material which demands a kilo price of about thirteen times the kilo price of lead. This makes such material unsuitable for sport-shooting, as mentioned above.

As mentioned in the international Publication, the material becomes very brittle when it contains the high percentages of bismuth mentioned above. This brittleness often causes the pellets to shatter when striking a target, such as the leg of a hunted animal. This renders bismuth pellets less suitable for use for hunting purposes and also for sport-shooting.

Neither the aforesaid Swedish patent specification nor the international Publication therefore defines a material for pellet or ball ammunition which is suitable for sport-shooting.

SUMMARY OF THE INVENTION

The present invention provides a material for pellet ammunition intended for sport-shooting which is able to replace lead pellet and lead ball ammunition. Although the ammunition material is particularly suited for pellet ammunition, it is also suitable for use as ball ammunition for sport shooting purposes. It can also be used for hunting purposes, both as pellet ammunition and ball ammunition.

The present invention thus relates to a material intended primarily for sport-shooting ammunition, both pellet ammunition and ball ammunition, which includes at least two of the materials zinc and bismuth, and is characterized in that the material includes above 55 percent by weight zinc; and in that the remainder of the alloy includes bismuth and tin, wherein the amount of tin present does not exceed approximately 10 percent by weight tin.

The invention will now be described in more detail, partly with reference to different exemplifying embodiments of the invention.

DESCRIPTION OF THE PREFERRED EMBODIMENTS

The invention thus relates to a material primarily for sport-shooting ammunition, particularly for pellet ammunition, but also for ball ammunition. The material comprises at least two of the materials zinc and bismuth.

Unlike the above mentioned known materials the inventive ammunition material comprises over 55 percent by weight zinc. The remainder of the alloy contains bismuth and tin, wherein the amount of tin present does not exceed about 10 percent by weight tin.

Zinc has a density of 7.1 g/cm$^3$. This is much lower than lead, which has a density of 11.3 g/cm$^3$, but is roughly comparable with iron, which has a density of 7.6 g/cm$^3$.

On the other hand, bismuth has a higher density, namely 9.8 g/cm$^3$. Naturally, when increasing the bismuth concentration, the density of the material will also increase. An alloy containing 55 percent by weight zinc and 45 percent by weight bismuth will have a density of 8.46 g/cm$^3$.

It has been found that this density is fully sufficient to provide sufficiently good ballistic properties so as to be generally comparable with lead pellets for sport-shooting purposes.

In addition, the inventive alloy has the property whereby the hardness corresponds to the hardness of lead pellets, meaning that the barrel pressure of the weapon will correspond to the pressure generated when firing lead pellet cartridges.

The inventive ammunition material also has a density sufficient to enable its use for hunting purposes. The inventive material is also sufficiently ductile so as not to shatter when striking a target, due to the high percentage of zinc used.

The inventive ammunition material is thus intended primarily for sport-shooting purposes and has properties that correspond in all essentials with lead pellets. One very important advantage in this regard is that pellet cartridges can be produced at a much lower price than bismuth pellet cartridges, because zinc is an inexpensive material.

The density and hardness of some usable zinc-bismuth alloys are listed below.

| Weight % Zinc | Weight % Bismuth | Density (g/cm$^3$) | Hardness HB (Brinell) |
|---|---|---|---|
| 55 | 45 | 8.46 | 31–38 |
| 60 | 40 | 8.03 | 31–33 |
| 65 | 35 | 8.00 | 34–36 |
| 70 | 30 | 7.84 | 30–38 |

By way of comparison, it can be mentioned that lead pellets have a hardness of 25–30 HB, i.e. a hardness which is in the same order of magnitude as the listed hardness.

It is pointed out that the hardness is not affected to any appreciable extent when replacing some of the bismuth in the Table with tin, although at most 10 percent by weight tin, although the density will fall slightly, since tin has a density of 7.3 g/cm$^3$ whereas the density of bismuth is 9.8 g/cm$^3$.

Tin is a metal whose price corresponds to the price of bismuth. Tin is added to the alloy in a certain amount in order to enhance the moldability of the alloy.

According to one preferred embodiment of the invention, the material contains up to 70 percent by weight zinc and up to 30 percent by weight bismuth.

According to another embodiment, the material contains up to 70 percent by weight zinc and up to 10 percent by weight tin and the remainder bismuth.

According to one greatly preferred embodiment of the invention, the material contains up to 70 percent by weight zinc and less than 5 percent by weight tin and the remainder bismuth. Tin can be present in an amount as low as 1–2 percent by weight, so as to provide very good moldability.

The ammunition material has a density which corresponds to or is in the same order of magnitude as the density of lead, and consequently the ammunition will have the same ballistic and energetic properties as lead ammunition, or properties corresponding to said ammunition. Furthermore, the inventive material has generally the same hardness as lead, this property of the inventive ammunition therefore also being similar to the same property of lead. This provides a ductile ammunition which generates roughly the same barrel pressure as lead ammunition.

It is obvious that the skilled person will be able to mix the aforesaid materials or other materials in the inventive proportions chosen by the skilled person so as to obtain ammunition of desired density, and the present invention is therefore not restricted to any particular mixture.

It is evident that the present invention solves the problems mentioned in the introduction concerning the use of lead pellets, since the materials and substances used do not have the same negative effect on the environment as lead.

The present invention is therefore not restricted to the aforedescribed exemplifying embodiments, since variations are possible within the scope of the following claims.

What is claimed is:

1. A ballistic projectile for sport-shooting in both pellet form and ball form, said projectile consisting essentially of zinc, bismuth, and tin, wherein the projectile is formed from a material that consists essentially of more than 55 percent by weight zinc, about 1 percent to 10 percent by weight tin and, the remainder bismuth.

2. A ballistic projectile according to claim 1, wherein the zinc is not more than about 70 percent by weight and bismuth is not more than about 30 percent by weight.

3. A ballistic projectile according to claim 1, wherein the zinc is not more than about 70 percent by weight and tin is not more than about 10 percent by weight and the remainder bismuth.

4. A ballistic projectile according to claim 1, wherein the zinc is not more than about 70 percent by weight and tin is not more than about 5 percent by weight and the remainder bismuth.

* * * * *